US009097204B2

(12) United States Patent
Chapman

(10) Patent No.: US 9,097,204 B2
(45) Date of Patent: Aug. 4, 2015

(54) CYLINDER HEAD CONFIGURATION FOR INTERNAL COMBUSTION ENGINE

(75) Inventor: Ben Chapman, Brixworth (GB)

(73) Assignee: Ilmor Engineering Limited, Brixworth, Northamptonshire (GB)

( * ) Notice: Subject to any disclaimer, the term of this patent is extended or adjusted under 35 U.S.C. 154(b) by 0 days.

(21) Appl. No.: 14/003,270

(22) PCT Filed: Mar. 30, 2012

(86) PCT No.: PCT/GB2012/050722
§ 371 (c)(1),
(2), (4) Date: Oct. 2, 2013

(87) PCT Pub. No.: WO2012/131391
PCT Pub. Date: Oct. 4, 2012

(65) Prior Publication Data
US 2014/0026837 A1 Jan. 30, 2014

(30) Foreign Application Priority Data
Mar. 30, 2011 (GB) ..... 1105374.1

(51) Int. Cl.
*F01L 1/34* (2006.01)
*F02F 1/24* (2006.01)
(Continued)

(52) U.S. Cl.
CPC . *F02F 1/24* (2013.01); *F02F 1/242* (2013.01); *F02F 1/42* (2013.01); *F01L 2001/0537* (2013.01); *F02B 23/101* (2013.01); *F02B 2023/102* (2013.01)

(58) Field of Classification Search
CPC ..... F01L 2001/0537; F02B 2023/102; F02F 1/24; F02F 1/242; F02F 1/42
USPC ..... 123/90.22, 90.23, 90.16
See application file for complete search history.

(56) References Cited

U.S. PATENT DOCUMENTS 5,785,028 A 7/1998 Anderson et al.
5,799,638 A 9/1998 Tsuchida et al.
(Continued)

FOREIGN PATENT DOCUMENTS

DE 19720490 11/1998
EP 1707783 10/2006
(Continued)

OTHER PUBLICATIONS

Guggenmos et al., Internal Combustion Engine, US Patent Application Pub. No. US 2002/0017272 A1, Feb. 14, 2002.*
(Continued)

*Primary Examiner* — Ching Chang
(74) *Attorney, Agent, or Firm* — Boyle Fredrickson, S.C.

(57) ABSTRACT

A cylinder head (10) for an internal combustion engine, having at least two inlet valves (20) associated with the or each combustion chamber, the inlet valves (20) being supported in the cylinder head (10) with their axes spaced from one another in a first direction, at least two exhaust valves (22) with their axes of reciprocation also spaced from one another in the first direction and at least two receiving formations for operating elements (such as a spark plug (38) and fuel injector (40)), the receiving formations opening into the combustion chamber portion in a central region bounded by the heads of the valves, wherein the receiving formations are inclined to one another so as to diverge generally in the first direction as they extend away from the combustion chamber portion.

8 Claims, 4 Drawing Sheets

(51) Int. Cl.

| | |
|---|---|
| ***F02F 1/42*** | (2006.01) |
| *F01L 1/053* | (2006.01) |
| *F02B 23/10* | (2006.01) |

(56) References Cited

U.S. PATENT DOCUMENTS

| | | | | |
|---|---|---|---|---|
| 6,418,905 | B1 | 7/2002 | Baudlot et al. | |
| 7,234,437 | B2 * | 6/2007 | Hiraya et al. | 123/276 |

FOREIGN PATENT DOCUMENTS

| | | |
|---|---|---|
| EP | 1777403 | 4/2007 |
| FR | 2812030 | 1/2002 |
| GB | 2365071 | 2/2002 |
| JP | 10176596 | 12/1996 |
| JP | 2005220768 | 8/2005 |
| JP | 2005256791 | 9/2005 |
| WO | 2006017051 | 2/2006 |
| WO | 2008012549 | 1/2008 |

OTHER PUBLICATIONS

Hiraya et al. In-Cylinder Direct Fuel-Injection Engine, US Patent Application Pub. No. US 2--70084436 A1, Arp. 19, 2007.*

* cited by examiner

CYLINDER HEAD CONFIGURATION FOR INTERNAL COMBUSTION ENGINE

BACKGROUND AND SUMMARY OF THE INVENTION

The invention relates to internal combustion engines, and more specifically to the configuration of a cylinder head of an engine and of components associated with the, or each, combustion chamber thereof.

In a modern internal combustion engine, the cylinder head has inlet and exhaust passages which communicate with the or each combustion chamber defined between the cylinder head and the respective cylinder space therebeneath. Poppet-type inlet and exhaust valves are reciprocably supported in the cylinder head, and have heads which cooperate with seatings where the passages open into the combustion chamber, the valves being controlled to open and close the respective passages in the required timed relationship.

In addition to the valves and the inlet and exhaust passages controlled thereby, other devices need to be carried by the cylinder head to communicate with the, or each, combustion chamber. These devices are referred to herein using the general term "operating elements", and the mention of one of these specifically does not necessarily preclude the substitution of one of the other elements in its place. For example, there may be at least one spark plug in the case of a spark ignition engine, a fuel injector in the case of a compression-ignition engine, and some spark-ignition engines have fuel injected directly into each combustion chamber, requiring the provision of both an injector and spark plug for each combustion chamber. Other operating elements, e.g. a sensor, may be required to communicate with the combustion chamber.

It will be appreciated that terms such as "over", "beneath", and the like are used herein according to engine design convention, rather than referring literally to the disposition of the respective parts referred to. For example, it is accepted that an engine may have its cylinders disposed horizontally when installed in a vehicle for example, yet still be referred to as having overhead cams, despite the fact that when looking at the installed engine the cams are not physically located above the horizontal cylinders.

In order to achieve currently-desirable characteristics in respect of power output, fuel economy and exhaust emissions, many engines nowadays, especially those for automotive applications, utilise cylinder heads incorporating more than a single inlet and exhaust valve per cylinder, most commonly so-called "four valve" arrangements with two inlet and two exhaust valves per cylinder. A four valve arrangement can provide a greater valve area for flow of both inlet and exhaust gases in relation to the bore of the cylinder, than can fewer valves. The most common arrangement has two inlet valves disposed with their axes of reciprocation lying in a plane inclined to the centreline of the cylinder bore, the valves being spaced from one another in a first direction which may be and usually is, parallel to the engine's crank shaft. The axes of reciprocation of the valves may be parallel to one another, or inclined to one another. The axes of reciprocation of the exhaust valves lie in another plane which is oppositely inclined to the cylinder bore and which intersects the plane of the inlet valves; the exhaust valves being spaced as the inlet valves and parallel or inclined to one another. The exhaust valves themselves are spaced from the inlet valves in a direction which may be, and usually is, transverse of the first direction. The combustion chamber is of shallow pent roof configuration, which is desirable in achieving the required compression ratio.

In a spark ignition such engine, the spark plug typically is disposed centrally or nearly centrally between the heads of the valves to give a combustion process more favourable for fuel economy, exhaust emissions and power characteristics than would be found in alternative arrangements. In a compression ignition such engine, the fuel injector would so positioned to provide even distribution of fuel within the combustion chamber, to achieve a similar effect. In the case of an engine with both injector and spark plug extending into such chamber, it would be desirable for both of them to be centrally mounted to achieve this effect, although the space available for such positioning is severely limited particularly if the size of the valve heads is maximised.

It is broadly the object of the present invention to address the above-described problems of design of a cylinder head having multiple valves and also two or more operating elements communicating with each combustion chamber.

According to a first aspect of the invention, we provide a cylinder head for an internal combustion engine comprising at least one combustion chamber portion for defining, in an engine, a combustion chamber between it and a, or a respective, cylinder space therebeneath;

at least two poppet-type inlet valves associated with the or each combustion chamber portion, having heads which cooperate with seatings in the combustion chamber portion to control flow through respective inlet passage portions, the inlet valves being reciprocably supported in the cylinder head with their axes of reciprocation spaced from one another in a first direction;

at least two poppet-type exhaust valves having heads which cooperate with seatings in the combustion chamber portion to control flow through respective exhaust passage portions, the exhaust valves being reciprocably supported in the cylinder head with their axes of reciprocation also spaced from one another in the first direction; and at least two receiving formations for operating elements, the receiving formations opening into the combustion chamber portion in a central region bounded by the heads of the valves;

wherein the receiving formations are inclined to one another so as to diverge generally in the first direction as they extend away from the combustion chamber portion.

Preferably, the exhaust valves are spaced from the inlet valves in a second direction transversely of the first direction, and the receiving formations are spaced from one another in the second direction.

Preferably the receiving formations are spaced from one another transversely of the engine relative to the crankshaft.

Preferably, the receiving formations are adjacent one another at their respective ends proximate to the combustion chamber portion.

The axes of reciprocation of the inlet valves may be substantially parallel to one another and lie in a first plane.

The axes of reciprocation of the exhaust valves may be substantially parallel to one another and lie in a second plane.

The first and second planes may be inclined to one another, and may intersect generally in the cylinder space(s).

The axis of intersection between the first and second planes may be substantially parallel to the rotary axis of a crankshaft of an engine wherein the cylinder head is to be used.

The operating elements may comprise a spark plug and an injector.

In the invention, the elements are disposed in the centre section between the valves, allowing the injector and spark plug to be mounted closest to the inlet and exhaust valves respectively. They are disposed in close proximity to one another, to allow minimal effect on valve size. Contrary to existing cylinder head designs where the injector and spark plug are mounted side by side, only the narrower ends of the injector and the spark plug are alongside one another, which allows their tips to be closer together than in other designs. The injector and spark plug are disposed at an opposing angle to one another, so that the wider upper regions of the spark plug and injector bodies are apart.

The invention also provides an internal combustion engine having a cylinder head according to the first aspect of the invention.

The injector may be adapted to distribute fuel in such a way as to compensate for the angle at which it is disposed, and provide a substantially symmetrical distribution of fuel relative to the cylinder centre axis. Thus the injector may have an asymmetrical spray pattern which is provided to compensate for the angle of the injector. This gives the same effect as having the injector in a directly upright position, but avoids the packaging constraints that this creates.

BRIEF DESCRIPTION OF THE DRAWINGS

An embodiment of the invention will now be described, by way of example only, with the aid of the accompanying drawings, of which.

DETAILED DESCRIPTION

Figure 1:
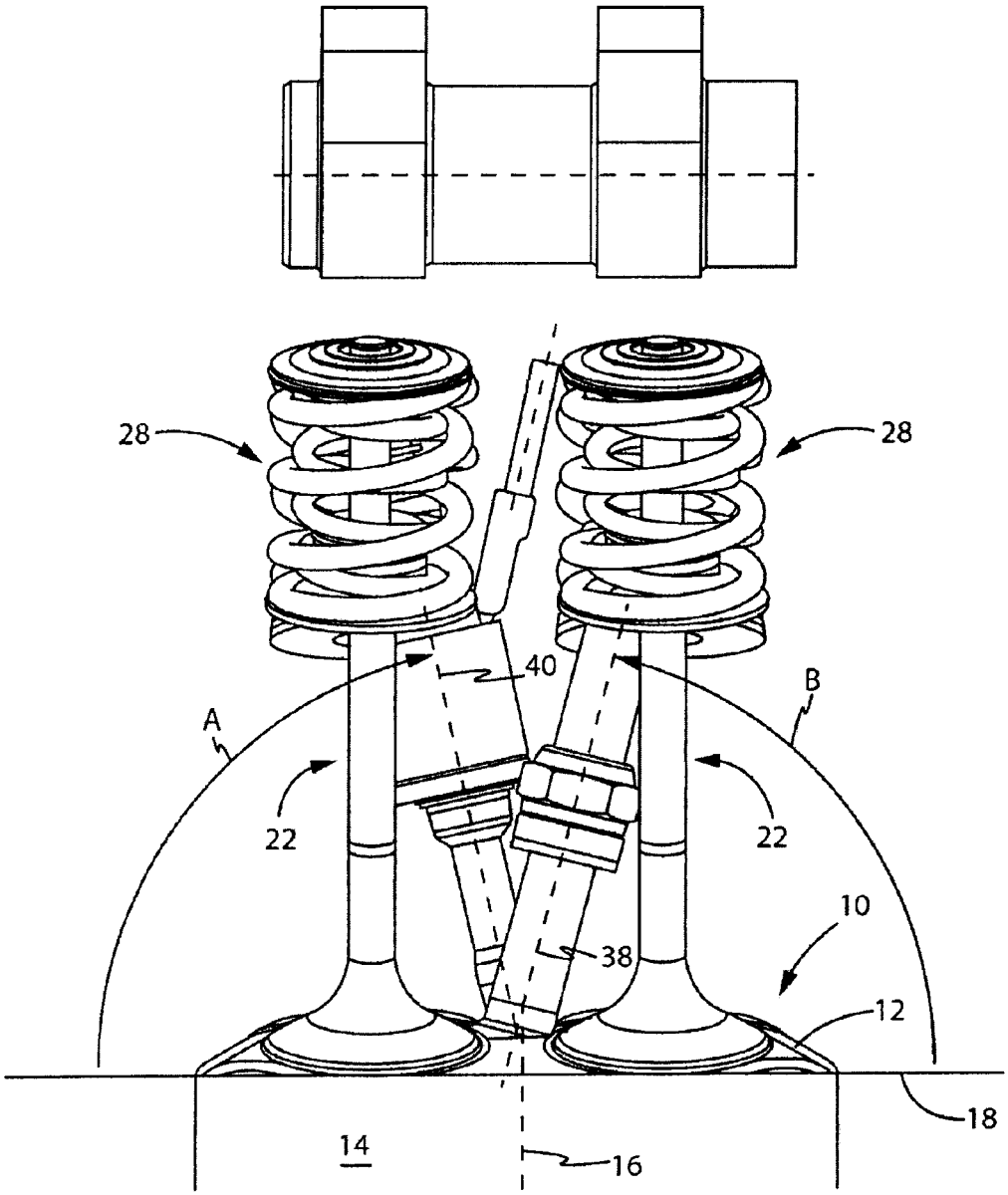
FIG. 1 shows the operative components of part of a cylinder head according the invention, from the exhaust side.
Figure 2:
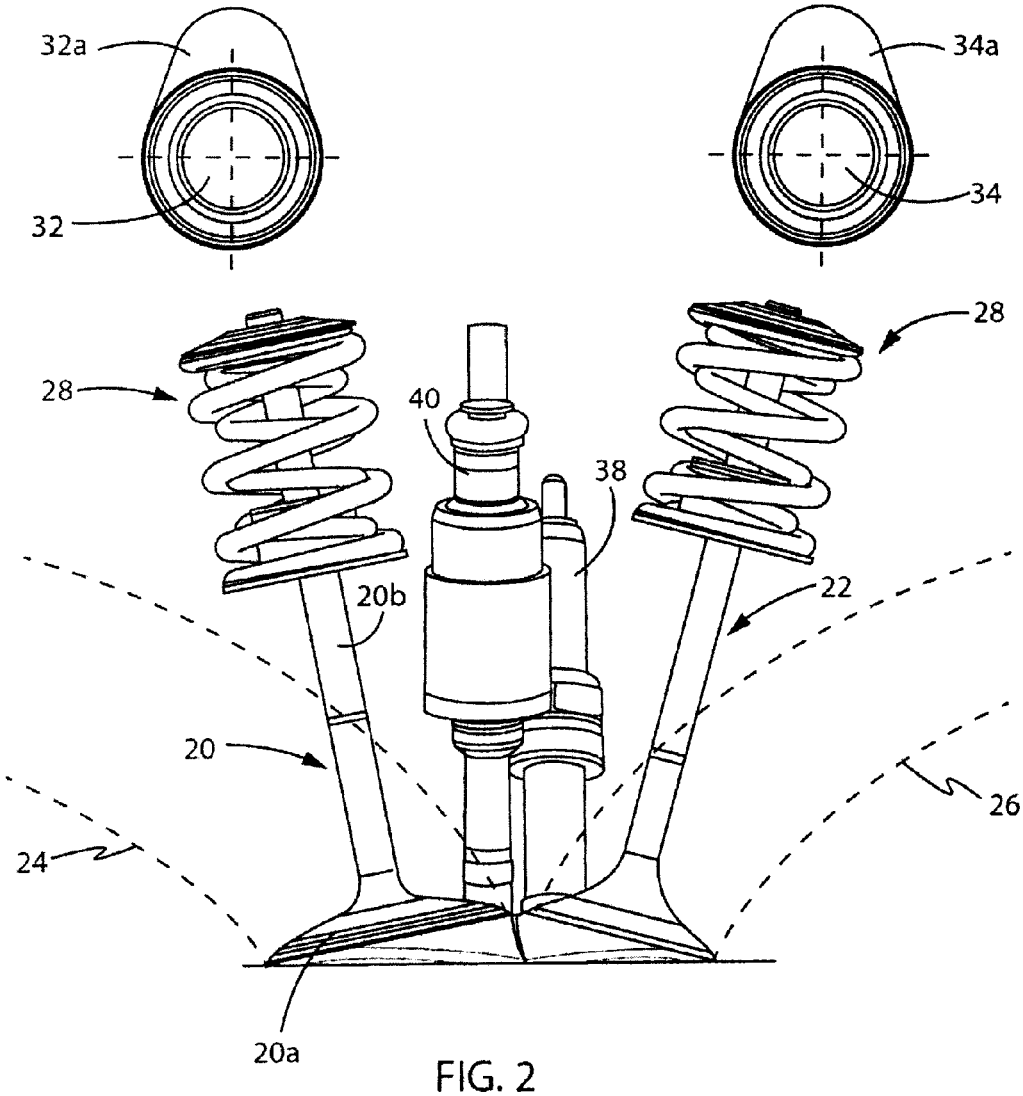
FIG. 2 is a view of the operative components of the invention, looking along the cylinder head with the inlet side on the left and the exhaust side on the right.
Figure 3:
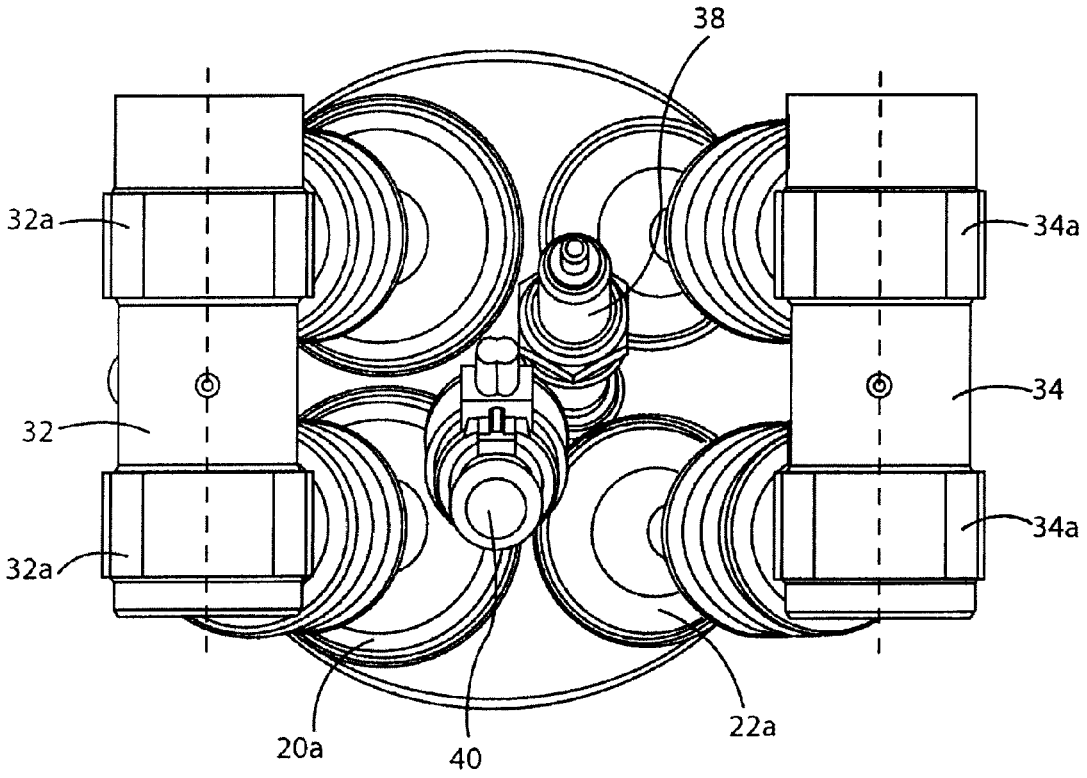
FIG. 3 is a view of the operative components of the invention from directly above the cylinder head.

Referring firstly to FIGS. 1 to 3 of the drawings, these show the principal components with which the invention is concerned in a cylinder head of a reciprocating internal combustion engine. Although a cylinder head is not shown in any detail, the illustrated parts relate to a combustion chamber portion indicated generally at 10, which defines a roof portion 12 of a combustion chamber, facing a cylinder space 14 within which a piston (not shown) is reciprocable, the centre line of the cylinder (and axis of reciprocation of the piston) being indicated at 16. A lower surface or deck 18 of the cylinder head, which is planar, seats on a facing upper surface of a cylinder block in which the cylinder space 14 is provided.

The cylinder head 10 may be entirely conventional apart from the particular disposition of certain components in accordance with the invention, as hereafter described. It may be a cylinder head of a multi-cylinder engine, in which case the cylinder head may be provided with a number of combustion chamber portions as 10, each with its own set of related components.

The illustrated combustion chamber portion 10 of the cylinder head has two inlet valves 20 and two exhaust valves 22. These are poppet valves, each of the inlet valves comprising a head 20*a* and valve stem 20*b*, and each of the exhaust valves also comprising a valve head and a valve stem. The stem of each valve is supported in a suitable valve guide in the cylinder head, so that the valve is reciprocable along an axis which is the central longitudinal axis of the respective valve stem. The valve heads are engageable with respective seatings in the combustion chamber portion of the cylinder head, so that the valves are able to control gas flow through respective inlet passages and exhaust passages provided in the cylinder head. FIG. 2 shows an inlet valve 20 and an exhaust valve 22 respectively in their closed positions, in which they close off an inlet passage 24 and an exhaust passage 26 in the cylinder head. The illustrated form of the passages 24, 26 is diagrammatic only.

The valves 20, 22 are each spring-biased to the closed position in which they are depicted, by respective valve closure spring assemblies as indicated at 28. Such valve spring assemblies, each comprising two oppositely-coiled helical compression springs compressed between a valve cap carried adjacent the free end of the respective valve stem and an abutment plate engaging a support surface on the cylinder head, are well known to persons skilled in the art and therefore will be described no further herein.

For displacing the valves from the closed position when required, any suitable valve-operating mechanism may be provided. As illustrated, a double overhead cam shaft arrangement is adopted, comprising an inlet cam shaft 32 for operating the inlet valves 20, and an exhaust cam shaft 34 for operating the exhaust valves 22. The cam shafts are driven in timed relationship to the engine by any suitable drive mechanism, and any appropriate cam-follower mechanism or component(s) are interposed between the cam formations (32*a*, 34*a*) on the cam shafts so that the valves are opened and allowed to close in accordance with the configuration of the cam formations. Provision may be made for varying the timed relationship between the rotation of the engine and the rotation of the cam formations, in known manner.

It is known that valves of internal combustion engines can be controlled by means other than the illustrated arrangement of cam shafts and return springs. For example, pneumatic valve-return devices have been utilised in place of metal springs. It has even been proposed that valves could be operated electro-hydraulically. An engine in accordance with the invention may, alternatively, utilise one such methods.

The axes of reciprocation of the illustrated inlet valves 20 lie spaced from one other in a plane inclined to the cylinder axis 16, and the axes of reciprocation of the exhaust valves 22 similarly be in a second plane oppositely inclined to the cylinder axis 16. If the engine is a multi-cylinder engine, all the axes of reciprocation of the inlet valves may lie in a common plane, and similarly all the axes of reciprocation of the exhaust valves may lie in a further common plane. The planes may intersect at some point in the cylinder space or spaces generally below the combustion chamber(s), and such planes intersect in a line parallel to the rotational axis of the engine's crankshaft. The axes of reciprocation of the inlet valves may be parallel or inclined to one another and those of the exhaust valves may also be parallel or inclined to one another.

From consideration of FIG. 3 of the drawings, it will be apparent that with the above-described arrangement of valves the heads thereof are of such a size that the seatings in the combustion chamber portion of the cylinder head approach one another very closely in the region of the cylinder axis 16. Hence, the space available for accommodation of operating elements namely a spark plug 38 and fuel injector 40, received in respective receiving formations in the cylinder head which open into the combustion chamber beneath the combustion chamber portion 10 thereof, is extremely limited. Such receiving formations are not shown in detail in the illustrations; typically the receiving formation for a spark plug is a screw-threaded bore leading into the combustion chamber, while that for the fuel injector is similar, or an injector may be held by a clamping arrangement, although any suitable method may be utilised for holding such operating elements in place. In accordance with the invention, therefore, the receiving formations for the spark plug and fuel injector, and hence the spark plug and injector themselves, are inclined to one another so that they diverge from one another as they extend away from the combustion chamber, such divergence being generally in the direction in which the exhaust valves are spaced from one another and the inlet valves are spaced from one another. The receiving formations themselves lie adjacent one another in the direction across the combustion chamber, transversely of the direction in which the inlet valves are spaced from one another and the exhaust valves are spaced from one another. As illustrated, the spark plug 38 lies at the "exhaust" side of the combustion chamber, while the fuel injector is at the "inlet" side of the combustion chamber, although another arrangement may be utilised, if required. When we refer to the divergence of the receiving formations as they extend away from the combustion chamber, we mean the predominant orientation thereof so that operating elements received therein diverge at their remote ends; this does not preclude the possibility that where they open into the combustion chamber, and closely adjacent thereto, the receiving formations could approach each other more closely as they extend away from the chamber.

FIG. 1 shows the extent of such divergence of the receiving formations and the operating elements carried thereby. The central axes of the spark plug and the fuel injector are inclined at an acute angle to one another in side view, while the central axis of the fuel injector is inclined to the plane of the cylinder head deck 18 at an angle A, and the spark plug inclined to the cylinder head deck at an angle B. It will be appreciated from this drawing that the tips of the injector and spark plug proximate to the cylinder space are adjacent one another.

The above-described arrangement enables both the spark plug and fuel injector to be positioned near the cylinder axis 16, to achieve the above-described beneficial effects on the combustion process and the advantageous results thereof. By being inclined in the direction lengthwise of the engine (in the case of a multi-cylinder engine) and spaced transversely of the engine (in relation to the crankshaft), the ends of the spark plug and injector remote from the combustion chamber are well spaced from each other and from the valve operating mechanism components for the inlet valves and exhaust valves, which is advantageous in packaging terms for the cylinder head region of the engine. Similarly, their spacing at the point at which they meet the combustion chamber roof maximises the space available for large valve heads and the passages opening into the combustion chamber. This enables maximisation of the gas flow into and out of the engine, allowing engine efficiency and performance to be optimised.

Figure 4:
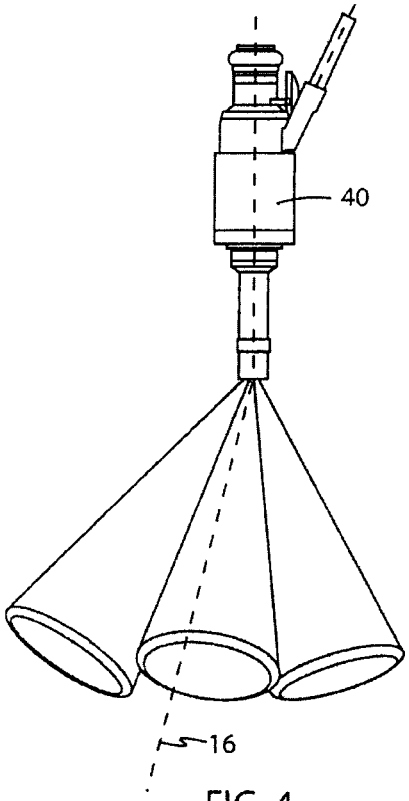
FIG. 4 is a view of an injector with an asymmetrical spray pattern from the side.
Figure 5:
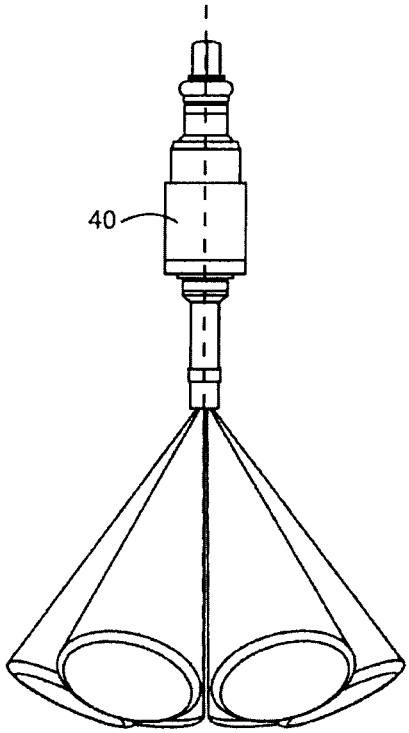
FIG. 5 shows the view in FIG. 4 rotated through 90 degrees.
Figure 6:
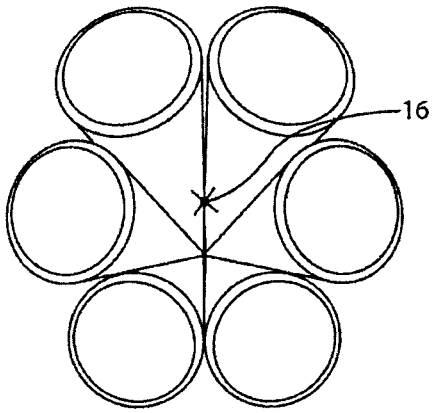
FIG. 6 shows the asymmetrical spray pattern of the injector from below.

In certain circumstances, it may be desired for the fuel injector to inject fuel into the cylinder space in a manner that the distribution of fuel is substantially symmetrical about the cylinder axis 16. To this end, the fuel injector 40 may have an asymmetric spray pattern, relative to the axis of the injector. This is illustrated with reference to FIGS. 4 to 6 of the drawings. These figures show the cones of fuel particles emerging from six outlet apertures of the fuel injector 40. The pattern of the cones of injected fuel is clearly seen in FIGS. 4 and 6, relative to the injector and orientation and position of the cylinder axis 16. It will be appreciated that the injection of fuel is substantially symmetrical relative to the axis 16, despite the inclination of the injector 40.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A cylinder head for an internal combustion engine having a crankshaft extending in a longitudinal direction with respect to the internal combustion engine and at least one cylinder with each cylinder defining a cylinder central axis, the cylinder head having a combustion chamber portion associated with each cylinder, the cylinder head comprising:

at least two inlet valves supported in the cylinder head, the inlet valves having inlet valve heads and inlet valve stems extending from the inlet valve heads and defining respective axes of reciprocation that are spaced from one another and are arranged in a first plane that is inclined with respect to the cylinder central axis;

at least two exhaust valves supported in the cylinder head, the exhaust valves having exhaust valve heads and exhaust valve stems extending from the exhaust valve heads and defining respective axes of reciprocation that are spaced from one another and are arranged in a second plane that is inclined with respect to the cylinder central axis;

at least a first receiving formation and a second receiving formation arranged on the cylinder head, wherein the first and second receiving formations are configured for receiving operating elements and opening into the combustion chamber portion in a central region bounded by the inlet valve heads and the exhaust valve heads, wherein the inlet valve heads and the exhaust valve heads are collectively arranged outwardly of the first and second receiving formations;

wherein the first and second receiving formations are inclined in opposite directions relative to the cylinder central axis and define respective first and second planes of inclination, wherein the first and second receiving formations diverge from each other and extend away from the combustion chamber portion, wherein each of the first and second planes of inclination of the first and second receiving formations is parallel to the crankshaft; and wherein the first and second receiving formations are aligned with and spaced from each other in a direction that is transverse with respect to the crankshaft and wherein the first and second receiving formations have respective first and second ends proximate the combustion chamber and arranged adjacent to each other.

2. A cylinder head according to claim 1 wherein the receiving formations are each inclined to a deck surface of the cylinder head.

3. A cylinder head according to claim 1 wherein the axes of reciprocation of the inlet valves are substantially parallel to one another.

4. A cylinder head according to claim 1 wherein the axes of reciprocation of the exhaust valves are substantially parallel to one another.

5. A cylinder head according to claim 1 wherein the axes of reciprocation of the inlet and exhaust valves in the first and second planes are inclined to one another and intersect in an inside cylinder space of the cylinder.

6. A cylinder head according to claim 1 where the operating elements comprise a spark plug and a fuel injector.

7. A cylinder head according to claim 6 wherein the fuel injector is adapted to distribute fuel in such a way as to provide a substantially symmetrical distribution of fuel relative to the cylinder central axis, asymmetrical relative to the fuel injector.

8. An internal combustion engine comprising a cylinder head according to any one of the preceding claims, the or each combustion chamber portion facing a respective cylinder of the engine.

* * * * *